US005984249A

United States Patent [19]

Cohen

[11] Patent Number: 5,984,249

[45] **Date of Patent: *Nov. 16, 1999**

[54] SUPPORT FOR MOUNTING CONTAINERS WITHOUT REQUIRING TOOLS

[75] Inventor: Michael Cohen, Glencoe, Ill.

[73] Assignee: Vista Products, Lake Forest, Ill.

[ * ] Notice: This patent is subject to a terminal disclaimer.

[21] Appl. No.: 08/925,958

[22] Filed: Sep. 9, 1997

Related U.S. Application Data

[63] Continuation-in-part of application No. 08/828,912, Mar. 28, 1997.

[51] Int. Cl.[6] ..... A01G 9/02

[52] U.S. Cl. ..... 248/226.11; 47/68; 108/47; 248/205.2; 248/214

[58] Field of Search ..... 248/214, 226.11, 248/228.3, 228.5, 228.6, 231.41, 231.61, 231.71, 208, 205.2; 108/47; 47/40, 66, 68

[56] References Cited

U.S. PATENT DOCUMENTS

| | | |
|---|---|---|
| 2,538,449 | 1/1951 | Freshwater . |
| 2,551,157 | 5/1951 | Price . |
| 2,614,471 | 10/1952 | Markowitz . |
| 3,588,019 | 6/1971 | Cozeck et al. . |
| 4,074,882 | 2/1978 | Anderson . |
| 4,141,524 | 2/1979 | Corverse, Jr. . |
| 4,331,312 | 5/1982 | LaVoe . |
| 4,559,738 | 12/1985 | Helfman . |
| 4,575,149 | 3/1986 | Forestal et al. . |
| 4,640,045 | 2/1987 | Nesbitt et al. . |
| 4,698,936 | 10/1987 | Helfman . |
| 5,177,899 | 1/1993 | Powell . |
| 5,240,214 | 8/1993 | Birnbaum et al. . |
| 5,269,095 | 12/1993 | Helfman et al. . |
| 5,368,266 | 11/1994 | Allen . |
| 5,368,267 | 11/1994 | Howard . |

*Primary Examiner*—Derek J. Berger

*Attorney, Agent, or Firm*—Martin L. Stern; Laff, Whitesel & Saret, Ltd.

[57] ABSTRACT

A supporting structure for a plant or flower box, or the like, fits over the top edge of a wall, room divider, or similar device. The supporting structure includes an elongated plate and a pair of L-shaped members, each member having a flange which depends below the elongated plate. The space between the two dependent flanges fits over and embraces the top edge of a room divider or the like. The other flange of each L-shaped member lays against the elongated plate which may be attached to the bottom of the box. In one embodiment, the L-shaped members have a flange which fits through a selected one of a plurality of spaced parallel slots formed in the elongated plate and is held in place at least in part by the weight of the box. In another embodiment, the bottom of a U-shaped member is secured to an elongated plate, with no adjustment of the space between a pair of flanges formed by open arms of the U-shaped members which slip over and embrace the top of a wall of known thickness. In yet another embodiment, the two L-shaped members have different lengths so that a greater range of space adjustments may be made by reversing the positions of the L-shaped members relative to the elongated plate. In this embodiment, the elongated plate has optional mounting bolt holes for securing the L-shaped members, which are each provided with an elongated slot in a horizontal leg to receive a mounting bolt. In each embodiment, a screw extends through one of the dependent flanges in order to tighten a grip on the wall.

20 Claims, 5 Drawing Sheets

SUPPORT FOR MOUNTING CONTAINERS WITHOUT REQUIRING TOOLS

FIELD OF THE INVENTION

This is a continuation-in-part application of U.S. patent application Ser. No. 08/828,912 filed Mar. 28, 1997, pending.

This invention relates to structures for supporting containers, such as plant or flower boxes, and more particularly to supports for mounting containers on top edges of walls, other room dividers or the like without requiring any tools or special training.

BACKGROUND OF THE INVENTIONS

Interior designers, florists, and the like, often wish to place objects on top of structures, such as free standing walls, or room dividers. These room dividers may have any of many different widths. For example, a conventional wall having 2×4 studs with wallboard on opposite sides may be, say, five or six inches thick. A prefabricated room divider supplied by a furniture company may be any thickness, such as two or three inches thick, for example. Other examples of room dividers and similar devices may have many other thicknesses.

As a result of these and other considerations, in the past, an interiorscaper, for example, might use a number of brackets if he wishes to mount a plant or flower box on the top of a partition. However, this approach creates potential problems. Normally, a number of tools may be required to assemble the brackets or support. The assembly of brackets and other supporting structure may be labor intensive, expensive and unsightly.

Among other considerations is the need for greater strength in the supporting brackets. For example, one of the conventional limitations has been the weight which could be supported by the brackets. To keep weight at a minimum, interiorscapers would place small grow pots in a planter, which restricted planter arrangements. With brackets having greater weight supporting capabilities, the separate grow pots can be eliminated and larger plants can be planted directly into the planter. All of this improvement in weight supporting capabilities should be accomplished without sacrifice of adjustability, ease of assembly, and the like.

Accordingly, there is a need for an unobtrusive, supporting structure which almost anyone may assemble. Also, the need is to provide a support which is adjustable to fit across the top of almost any wall, room divider, or the like.

SUMMARY OF THE INVENTION

In keeping with an aspect of one embodiment of the invention, an elongated plate has a number of spaced parallel slots on each end. Each elongated plate has an associated pair of L-shaped bracket members with a first flange which fits through any selected one of the slots, to depend beneath the elongated plate. The slots which are selected provide a space between the two dependent flanges which is approximately equal to or slightly greater than the width of the wall or room divider. This way, the two dependent plates may embrace the wall. The other flange of each of the L-shaped members lies flat on top of the elongated plate where it may be held in place by the weight of a planter, or the like, sitting on top of the elongated plate. Or, in the alternative, the leverage of the L-shaped plates acting against a fulcrum formed by an edge of a slot holds the L-shaped plate in place. The first and dependent flange, which fits against the wall, is penetrated by a screw which may be turned to grip the wall. The elongated member and L-shaped brackets are preferably made by stamping sheet metal; however, any other suitable material may be used.

In keeping with an aspect of another embodiment of the invention, an elongated plate has an aligned number (here three) of mounting holes which enable a bolt to pass though a hole at the center, left of center, or right of center positions. Two L-shaped members have flanges that fit into a channel formed by dependent edges of the elongated plate. Each flange contains an elongated slot for enabling a longitudinal adjustment of the position of the L-shaped member. One flange is relatively long and the other flange is relatively short. Hence, by selecting a single one of the mounting bolt holes and by selecting whether the long or short flanges fit on the left or right end of the elongated plate, the dependent flanges may be located at almost any positions, limited only by the length of the elongated plate.

BRIEF DESCRIPTION OF THE DRAWINGS

A preferred embodiment of the invention is shown in the attached drawing in which.

DETAILED DESCRIPTION OF EMBODIMENTS OF THE INVENTION

Figure 1:
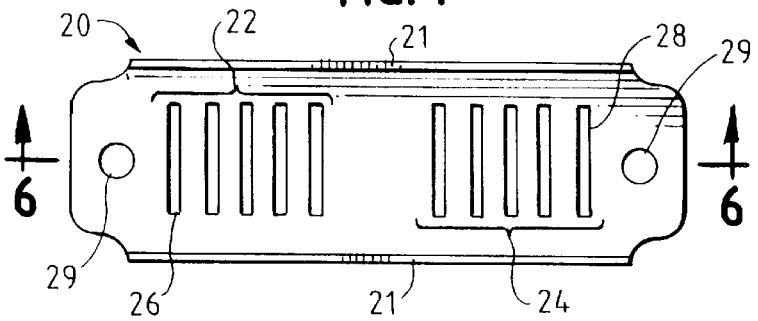
FIG. 1 is a plan view of an elongated member for a first embodiment of the invention.

FIG. 1 shows an elongated plate 20 having two sets of anchor sites in the form of a plurality of spaced parallel slots 22, 24 associated with and transverse to each end of the plate. Each longitudinal side of plate 20 terminates in an upturned edge 21 which forms a fence at the edge of plate 20. Any one of the slots in each of the two groups 22, 24 may be selected according to the width of a wall, room divider, or other device on which the assembled support member is to rest. For example, if the width of the wall 25 (FIG. 6) is "X," the slots 26, 28 will be selected because they are separated by a distance approximately equal to or slightly greater than "x." A pair of holes 29 are formed in the opposite outboard ends of the elongated plate 20 to provide a way of attaching the elongated plate to the bottom of a planter box, if necessary.

Figure 2:
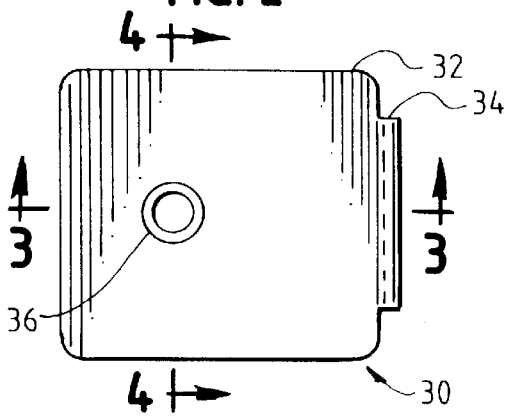
FIG. 2 is an elevation view of an L-shaped flange member which fits against the wall.
Figure 3:
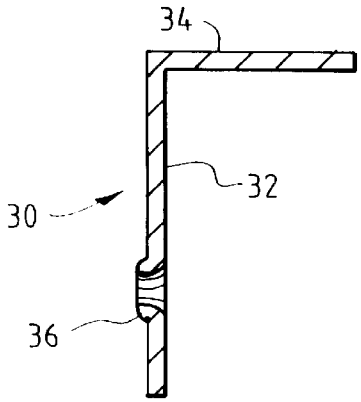
FIG. 3 is a cross sectional view taken along line 3—3 of FIG. 2.
Figure 4:
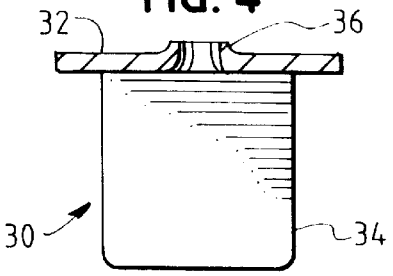
FIG. 4 is a cross section taken along line 4—4 of FIG. 2.
Figure 5:
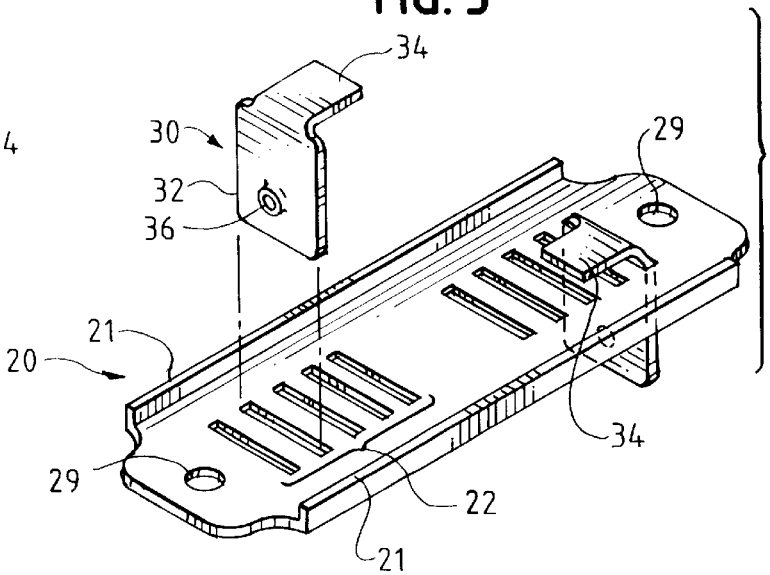
FIG. 5 is a perspective view of the elongated member of FIG. 1 with one of the L-shaped members in place and with a second L-shaped member poised over the elongated plate and about to be inserted into a slot.

Two L-shaped members 30 (FIGS. 2–4) are supplied and associated with the elongated plate 20. Each L-shaped member has a first flange 32 which is shaped and dimensioned to fit through any one of the anchor site slots 22, 24 and to depend from plate 20. The other flange 34 of the L-shaped member 30 is shaped and dimensioned to fit comfortably between the fences formed by upturned edges 21—21 on plate 20.

Figure 6:
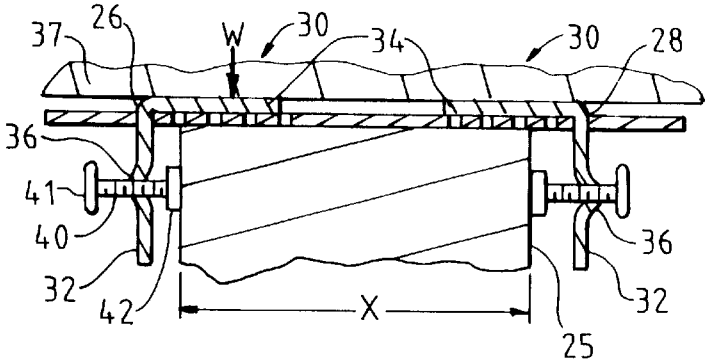
FIG. 6 shows a fragment of the assembled support (taken along line 6—6 of FIG. 1) with a planter box, or the like, holding the assembly in place.

The outer end of the first flange 32 contains a flared detent 36 which projects slightly above the surface of the flange 34 in order to provide a threaded hole. If the threaded detent 36 projects too far and does not pass through a slot 22 or 24, the other flange 34 may be inserted through the slot and then the L-shaped member is rotated into the position with flange 32 depending below and flange 34 laying on the plate 20. In the embodiment of FIG. 6, when a planter box 37 is set upon the assembly, the weight W (FIG. 6) of the box tends to cause the L-shaped member 30 to be locked in place.

A clamp 40–42 having threaded bolt 40 is mounted in the threaded hole formed by the flared detent 36. On the outer end of the threaded bolt 40, a handle 41 enables the installer to turn the bolt. On the inner end of the bolt, a relatively flat clamping member 42 is positioned to grip the wall responsive to a turning of the bolt 40. Preferably, the handle 40 is removable. Or, either the handle 41 or the flat member 40 is installed on bolt 40 after it is threaded through hole 36. Alternatively, a screwdriver, or the like can turn the bolt 40.

Figure 7:
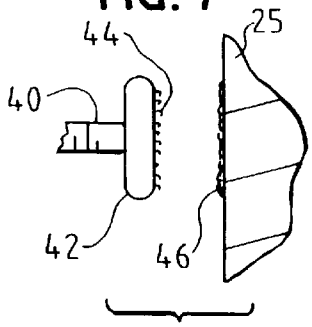
FIG. 7 is a schematic view of an end of a clamp used to secure the assembly to a room divider.

As best seen in FIG. 7, the clamping member 42 is covered with the hooks 44 of a hook and loop fastener sold under the trademark "Velcro." The loops 46 of the "Velcro" fastener are adhered to the wall. Usually, these "Velcro" members are secured by a self-adhesive covered by a release paper (not shown) until the members are installed. The easy way to make this installation is to peel off the release paper on the hook side and stick the combination on the clamping member 42. Then, the release paper is peeled off the loop side and the clamp is tightened against the wall, thereby securing the loop side 46 in a nearly perfect position. The two dependent flanges 32, 32 now tightly embrace and clutch the wall 25.

Figure 8:
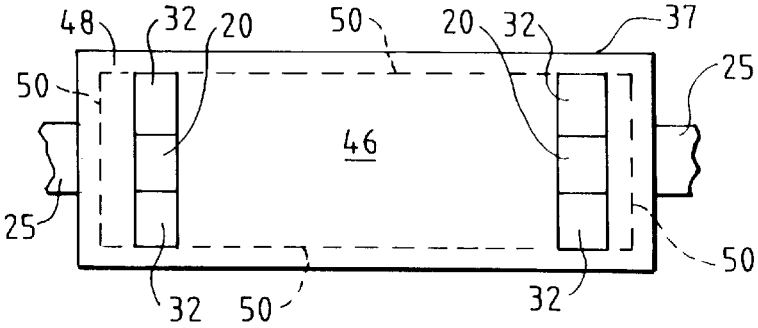
FIG. 8 is a schematic plan view of a room divider, a planter box, and the inventive support assembly.

In greater detail, FIG. 8 is a schematic plan view showing the inventive support in use. Two of the elongated plates 20 are preferably attached to the bottom of planter box 37 and the box is positioned over the top edge of a wall 25, room divider, or other support 25. These two plates are separated by a distance which puts them adjacent the ends of the planter box 37. Of course, the invention is not limited to a use of only two elongated plates 20. Any suitable number of supporting elongated plates 20 and their associated pair of L-shaped members 30 may be provided.

The flanges 32 may be either decorative to add to the appearance of the planter box; or, they may be neutrally colored to minimize their noticeability, when in place.

Figure 9:
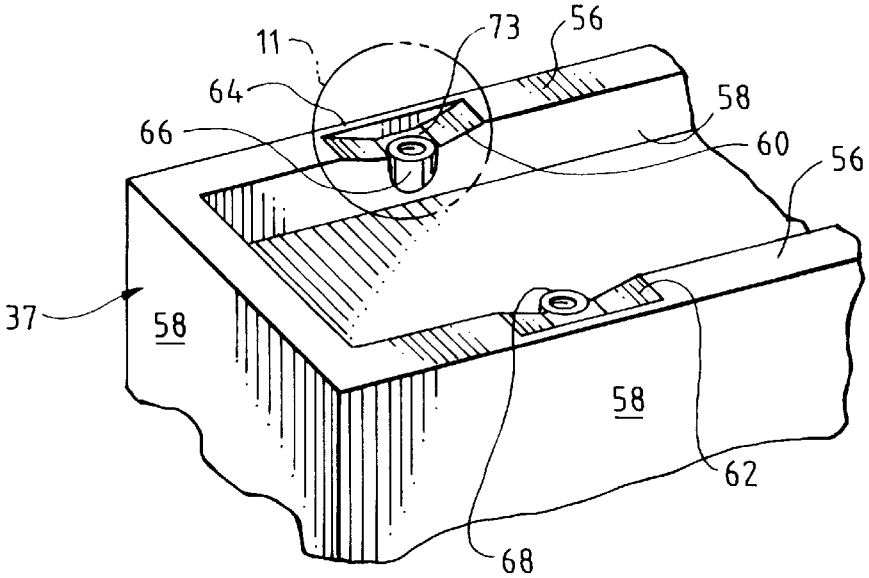
FIG. 9 is a perspective view showing a fragment of the bottom of a planter box before the invention is installed.
Figure 10:
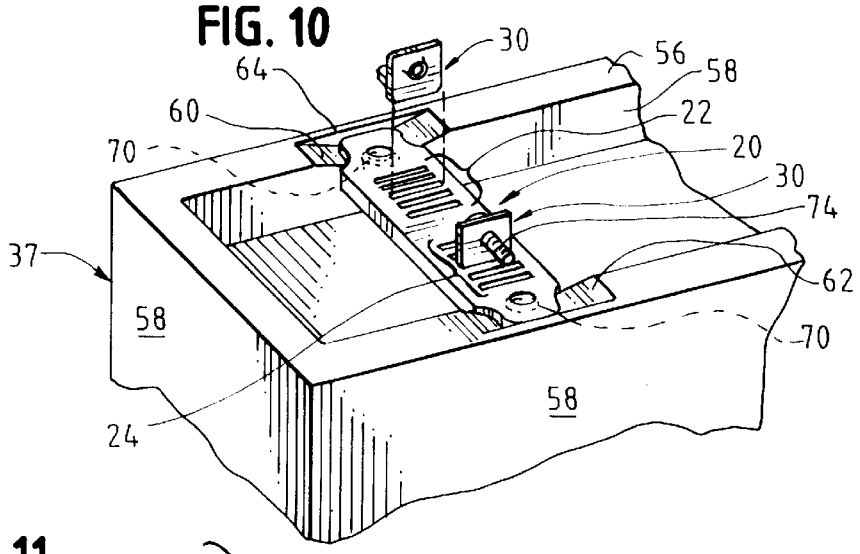
FIG. 10 is essentially the same as FIG. 9, except that the first embodiment of the inventive mount is installed on the planter box.
Figure 11:
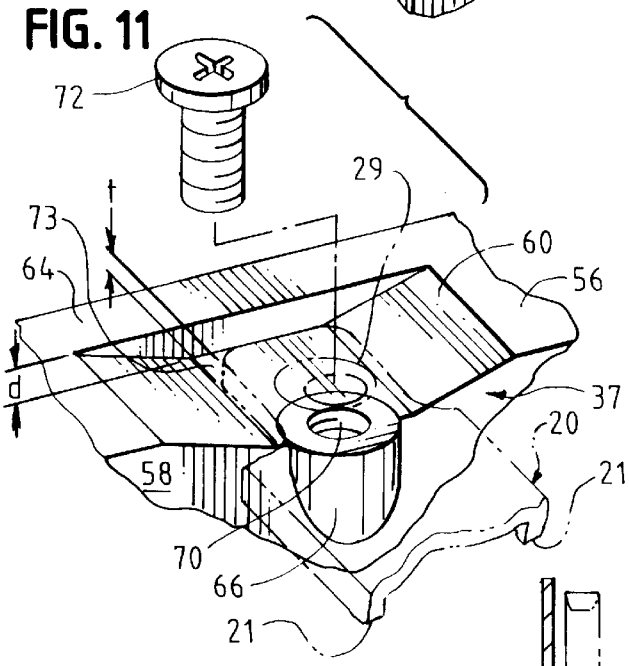
FIG. 11 is a showing of the detail 11 in FIG. 9 and with a fragment of the elongated plate shown in phantom lines.

In the embodiment of FIGS. 9–11, the planter box 37 has depressions 60, 62 formed in the lower surface of the side wall in order to receive the ends of the elongated plate 20. These depressions enable the ends of the elongated plates 20 to be approximately flush with the surface of the bottom wall.

In greater detail, the planter box 37 is preferably made of molded plastic of any suitable shape and design, although any other suitable material may be used. The bottom surface 56 of the box side walls 58 has a depression 60, 62 formed in each location where the end of an elongated plate 20 is to be attached to the box. Upstanding on one side of each depression is a thin wall 64 which has a depth d (FIG. 11) approximately equal to the thickness t of the end of plate 20 so that, after it is attached, the top surface of the plate is substantially flush with the exposed edge of thin wall 64 on the bottom surface 56 of the planter box side wall 58.

An upstanding boss 66, 68 is molded in each depression 60, 62 at a location where it will receive mounting hole 29 (FIGS. 1 and 11) near the end of the elongated plate 20. Each boss has a hole 70 therein for receiving a bolt 72 which secures plate 20 to the planter box 37.

The height of the boss above the floor 73 of the depression is approximately equal to the depth d of thin wall 64 and thickness t of the end of elongated plate 20. Therefore, when holes 29 in the elongated plate 20 are in position over the bosses, the tops of the bosses will be approximately flush with or slightly countersunk below the surface of plate 20. The fit between plate and boss insures that the elongated plate 20 is securely held in place when bolt 72 is tightened into the hole 70 of the boss 66 or 68.

Figure 12:
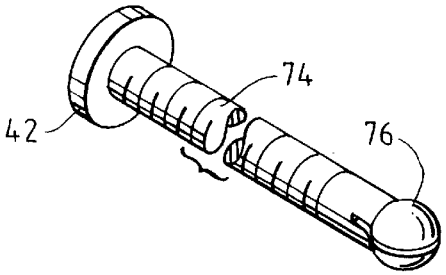
FIG. 12 shows a detail of an exemplary clamping screw for the embodiment of FIGS. 9–11.
Figure 13:
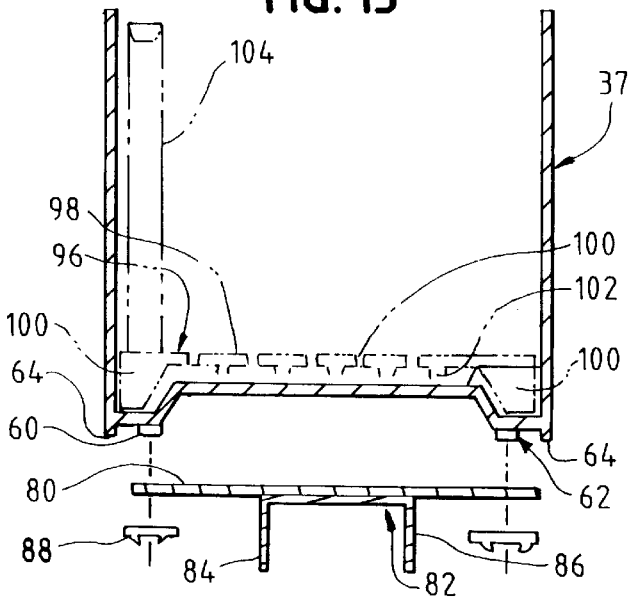
FIG. 13 is an exploded view, partly in cross-section, of a planter with a second embodiment of the inventive support which fits onto walls or room dividers of standard thickness.
Figure 14:
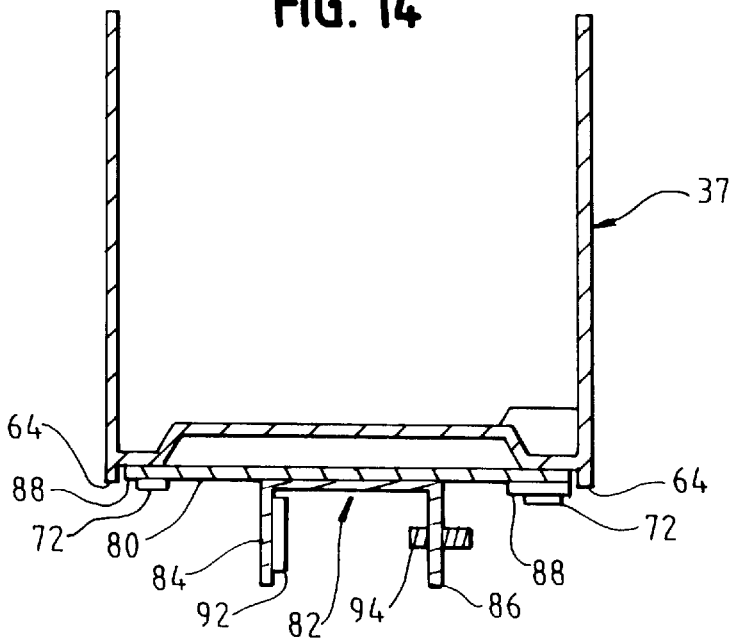
FIG. 14 is a view of the FIG. 13 bracket assembled on a planter box.

At least one of the L-shaped plates 32 may have a bolt 74 (FIG. 12) therein for tightening the support to the wall, room divider 25 (FIG. 6) or the like. This bolt may be constructed as bolt 40 (FIG. 6) is constructed with a face plate carrying a "Velcro" hook and loop fastener. It may simply have a slot 76 (FIG. 12) for receiving the blade of a screwdriver. Those skilled in the art will readily perceive other ways in which the end of bolt 74 may be shaped to accommodate other means for turning it.

Figure 15:
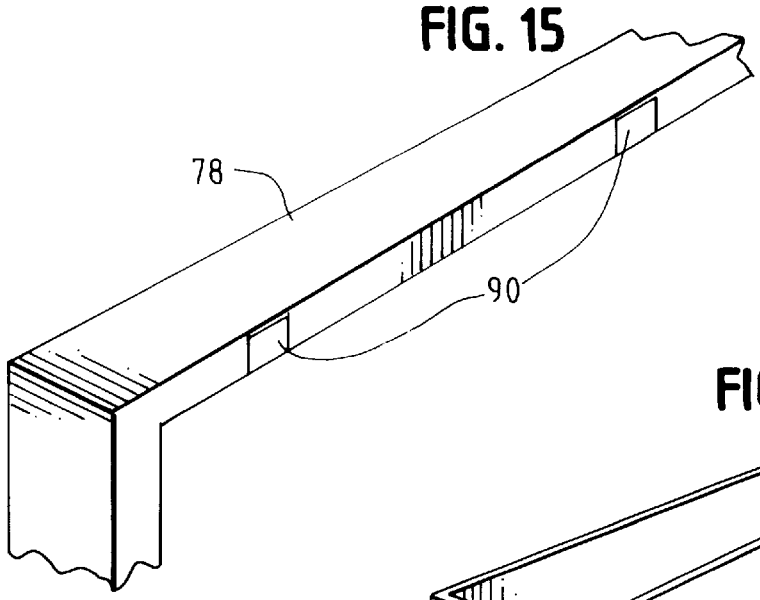
FIG. 15 is a perspective view of a type of room divider which may be supplied by a furniture manufacturer, for example.

Sometimes the thickness of the wall or room divider 78 (FIGS. 15, 16) is completely predictable. For this kind of an installation, there is no need for the adjustments which are described above and the embodiment of FIGS. 13–16 may be used.

The mounting structure comprises an elongated plate 80 having a U-shaped member 82 with the bottom of the U spot welded or otherwise jointed thereto. The U-shaped member 82 has two dependent flanges 84, 86 formed by the arms of the U which are spaced from each other by the thickness of the supporting wall or room divider 78. The elongated plate 80 fits over and is attached to bosses 60, 62, which are essentially the same as in FIGS. 9–11. Lock washers 88 may be supplied, either here or in any of the other embodiments to help secure the bolts.

In this embodiment, preferably the loop side pieces 90 of "Velcro" hook and loop fasteners are fastened to the wall or room divider 78 at positions where the U-shaped members 82 are located. The hook side 92 of the "Velcro" fastener is located inside the flange 84 of the U-shaped member 82 which confronts the fastener pieces 90 on the wall or room divider. The opposite flange 86 has a bolt 94 for tightening against the wall.

Figure 16:
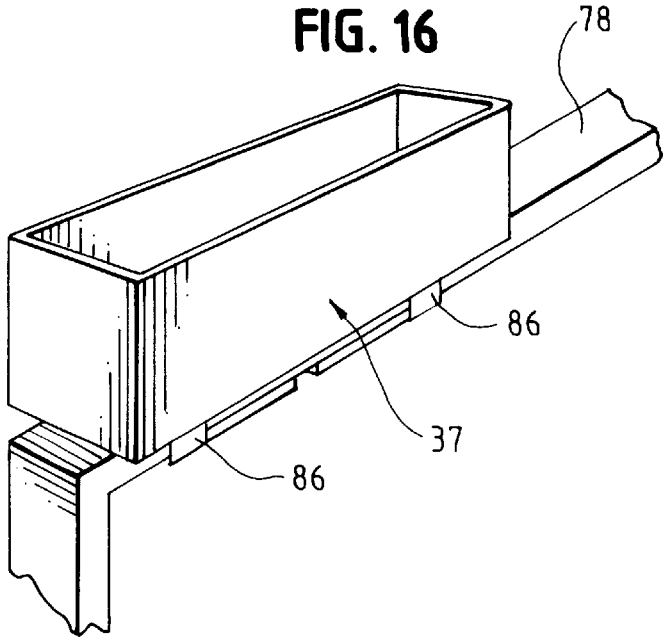
FIG. 16 shows a planter box for use with the embodiment of FIGS. 13–15, but it could also use any of the embodiments, mounted on a wall or divider.

FIG. 16 shows the planter box 37 of the embodiment of FIGS. 13–16 mounted on the wall or room divider 78.

The embodiment of FIGS. 1–8 only requires an insertion of flange 32 into a selected slot 22 or 24. Thus, it is quick and easy to use. On the other hand, the slots 22 and 24 extend a considerable distance across the width of the elongated plate 20. Thus, the plate 20 has a limited strength and is appropriate for use with smaller planter pots. Also, the slots 22 and 24 are spaced to give incremental adjustments which are appropriate for use with walls of predictable thickness.

When these features are important, the embodiment of FIGS. 1–8 is used.

Another embodiment of the invention is shown in FIGS. 17–20. This embodiment is designed to provide an infinite range of adjustments limited only by the length of the elongated plate 20*a*. The embodiment of FIGS. 17–20 is important when greater strength and an infinite spacing (within the useful range) is important. The greater strength comes about by an elimination of the slots 22 and 24 extending across most of the width of the elongated plate. The greater adjustability comes about by providing two L-shaped members with flanges of different lengths, and with unbroken adjustment slots, and by providing a plurality of mounting holes on the elongated plate.

In greater detail, the elongated mounting plate 20*a* has spaced parallel fences formed by turned down edges 21*a* on each of its opposite longitudinal sides. Optional anchor sites are provided by a plurality (here three) of mounting holes 200, 202, 204 formed along the length of elongated plate 20*a*.

Figure 17:
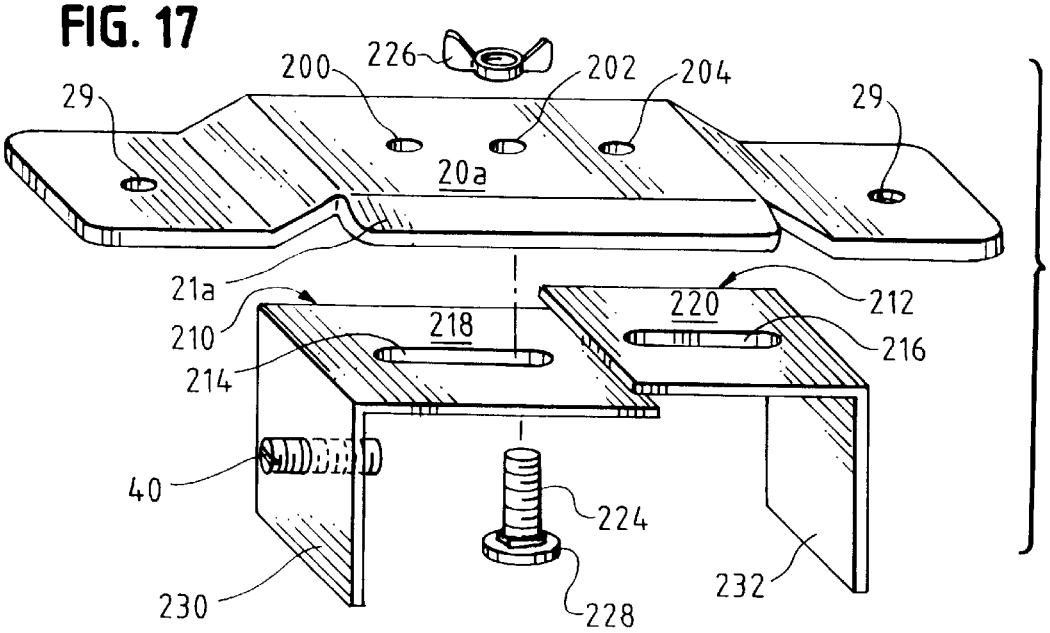
FIG. 17 is an exploded perspective view of a third embodiment of the invention having a greater range of adjustability.

A pair of overlapping L-shaped members 210, 212 have adjustment slots 214, 216 formed therein. The width of the L-shaped members is such that it fits comfortably between the fences formed by downturned edges 21*a*. The overlapping flanges 218, 220 of the L-shaped members have unequal lengths, flange 218 being relatively long and flange 220 being relatively short. The long and short flanges may be positioned as shown in FIG. 17; or, they may be reversed with long flange 218 on the right and short flange 220 on the left. This gives a greater variety of adjustments.

A bolt 224 fits through the two adjustment slots 214, 216 and a selected one of the anchor site mounting holes 200, 202, 204. A wing nut 226 fits on top of bolt 224 in order to complete the assembly by securing the parts 20*a*, 210, 212 between the fences 21*a*. Bolt 224 has a square shoulder 228 near its head. The shoulder fits into slots 214, 216 tightly enough to prevent the bolt from turning when wing 226 is tightened.

This way, by selectively placing the long flange on the left or right and by selecting a specific one of the mounting holes 200–204, the vertical flanges 230, 232 may be located almost anywhere within the useful range provided by the physical dimensions of the parts including the lengths of the adjustment slots 214, 216 and the elongated plate 20*a*.

Figure 18:
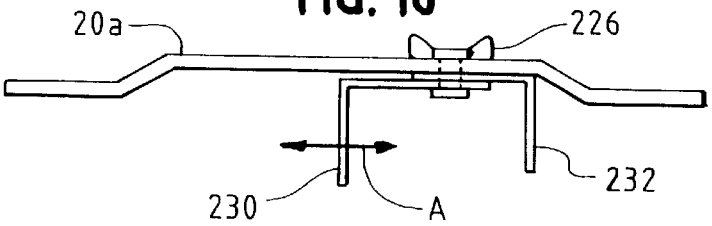
FIGS. 18–20 are three schematic views showing how the flanges of FIG. 17 may be secured on the right, center or left of the mounting bracket in order to maximize adjustability.

For example, FIG. 18 is drawn to show the bolt 224 going through the bolt hole 204 located in the right-hand position on elongated plate 20*a*. The long L-shaped member 218 is on the left so that the long adjustment slot 214 provides a maximum travel of a dependent flange 230 on the left (Arrow A). The position of short flange 232 is also adjustable, but the short adjustment slot 216 provides a more limited travel, as compared to the travel of flange 230.

Figure 19:
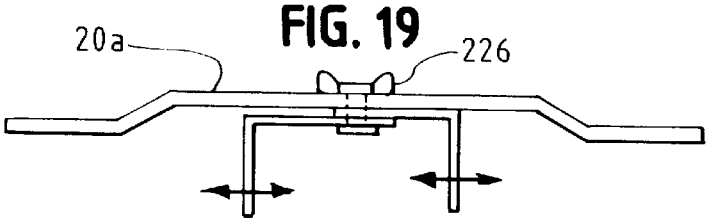

FIG. 19 places the bolt 224 in the center hole 202 so that each of the flanges 230, 232 may have the maximum travel afforded by the lengths of their respective adjustment slots 214, 216.

Figure 20:
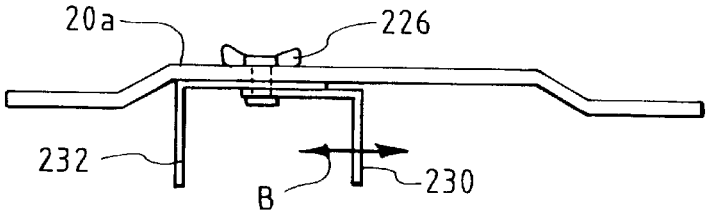

In FIG. 20, the positions of L-shaped members 210, 212 are reversed so that the long flange 230 with the maximum travel is on the right (Arrow B).

In any of the embodiments, an irrigation unit 96 (shown in phantom in FIG. 13) may be provided. This unit provides a drip space and enables the watertight planter box to supply only the amount of water which a plant needs over a two to three week period. An advantage of this arrangement is that there is no over watering. There is a convenience and a saving of labor, as compared to the prior art. The planter box is specifically designed to receive various sub-irrigation systems, which is a substantial advantage over previous planter boxes.

Those who are skilled in the art will readily perceive how to modify the invention. Therefore, the appended claims are to be construed to cover all equivalent structures which fall within the true scope and spirit of the invention.

The claimed Invention is:

1. A support structure for mounting a box on a top edge of a wall member, said support structure comprising an elongated plate adapted to be positioned substantially transverse to a longitudinal dimension of said box, optional mounting sites spaced along the length of the elongated plate, a pair of L-shaped members each having a first flange and a second flange, and a fastener for securing said first flanges to a selected one of said optional mounting sites of said elongated plate such that the first flange on one of the L-shaped members overlaps the first flange on the other L-shaped member, and the two second flanges extend away from the elongated plate and confront each other to define a space between them.

2. The structure of claim 1, wherein each of said optional mounting sites is a mounting hole, each of said first flanges has an elongated adjustment slot therein, said adjustment slots being vertically aligned with one another and with a selected one of said mounting holes when said first flanges overlap one another and said fastener passes through each of said adjustment slots to secure said L-shaped members to said elongated plate via the selected one of said mounting holes.

3. The structure of claim 1 or 2 wherein said first flange on one of said L-shaped members is longer than the first flange on the other of said L-shaped members.

4. The structure of claim 1, wherein the elongated plate has down turned edges forming spaced parallel fences along the edges of said plate and the first flange on one of the L-shaped members fits between said fences.

5. The structure of claim 4 wherein each of said optional mounting sites is a mounting hole, each of said first flanges has an elongated adjustment slot therein, said adjustment slots being vertically aligned with one another and with a selected one of said mounting holes when said first flanges overlap one another and said fastener passes through each of said adjustment slots to secure said L-shaped members to said elongated plate via the selected one of said mounting holes.

6. A support structure for mounting a box on a top edge of a wall member, said support structure comprising an elongated plate adapted to be positioned substantially transverse to a longitudinal dimension of said box, optional mounting sites spaced along the length of the elongated plate, a pair of L-shaped members each having two flanges and dimensioned so that a first of said two flanges fits against said elongated plate, and means for securing said first flange of each of said L-shaped members to one of the optional anchoring sites on said elongated plate with the other of said two flanges dependent from said elongated plate, said other flanges confronting each other to define a space between them, wherein said optional anchor sites are a plurality of spaced parallel slots formed in said elongated plate, said slots being dimensioned for said other flanges to fit through them with said first flange laying on said elongated plate.

7. A support structure for mounting a device on the top edge of a wall member, said support structure comprising an elongated plate with a fence formed along each of its elongated edges and having a plurality of spaced parallel slots associated with each end of said plate; a pair of L-shaped members each having two flanges, a first of said flanges fitting between said fences formed along the elongated edges of said plate, the other of said flanges being shaped and dimensioned to fit through said slots and depend from said elongated plate, whereby each of said two of said other flanges is placed in a selected one of said slots to embrace opposite sides of said wall member, the first of said flanges lays on said elongated plate and between said fences.

8. The support structure of claim 7 and a threaded clamping member in at least one of said other flanges for securing said support structure to said wall.

9. The structure of claim 8, and a flared detent with a threaded hole formed in each of the said other flanges for receiving said threaded member which may be turned to form a clamp which enables a securing of said support structure to said wall.

10. The structure of claim 9 and a hook and loop fastener adapted to be attached between an end of said threaded member and said wall.

11. The structure of claim 10 wherein said hook and loop fastener has a hook side and a loop side, said hook side of said fastener is attached to said end of said threaded member and said loop side of said fastener is adapted to be attached to said wall.

12. The structure of claim 7 wherein said first flanges are adapted to be in positions where the weight of the device supported by said structure secures and stabilizes the position of said L-shaped members.

13. The structure of claim 7 further comprising a second elongated plate, the first elongated plate adapted to be disposed at one end of said device and the second elongated plate adapted to be disposed at the opposite end of said device.

14. A device comprising a box and a support structure, said support structure comprising an elongated plate positioned substantially transverse to a longitudinal dimension of said box, optional mounting sites spaced along the length of the elongated plate, a pair of L-shaped members each having a first flange and a second flange, and a fastener for securing said first flanges to a selected one of said optional mounting sites of said elongated plate such that the first flange on one of the L-shaped members overlaps the first flange on the other L-shaped member, and the two second flanges extend away from the elongated plate and confront each other to define a space between them.

15. The device of claim 14 wherein each of said optional mounting sites is a mounting hole, each of said first flanges has an elongated adjustment slot therein, said adjustment slots being vertically aligned with one another and with a selected one of said mounting holes when said first flanges overlap one another and said fastener passes through each of said adjustment slots to secure said L-shaped members to said elongated plate via the selected one of said mounting holes.

16. The device of claim 15 wherein a hole is formed in each end of said elongated plate to enable an attachment of said elongated plate to said box.

17. The device of claim 16, and a flared detent with a threaded hole formed in an end of at least one of said second flanges for receiving a threaded member.

18. The device of claim 17 and a hook and loop fastener adapted to be positioned between said threaded member and a wall.

19. The device of claim 16 wherein a bottom of said box is depressed at the position of the elongated plate so that an exposed surface of said elongated plate is flush with said box at said position.

20. The device of claim 19 and a boss formed in said depression for receiving said hole in said elongated plate, said boss including means for securing said elongated plate to said box.

* * * * *